United States Patent [19]

Ackermann et al.

[11] 4,215,852

[45] Aug. 5, 1980

[54] APPARATUS FOR LOCKING A CONVERTER TILTING GEAR DURING A BLASTING OPERATION

[75] Inventors: Wilhelm Ackermann, Essen; Karlheinz Langlitz, Mulheim; Günter Schmitz, Duisburg, all of Fed. Rep. of Germany

[73] Assignee: DEMAG, Aktiengesellschaft, Duisburg, Fed. Rep. of Germany

[21] Appl. No.: 862,336

[22] Filed: Dec. 20, 1977

[30] Foreign Application Priority Data

Dec. 24, 1976 [DE] Fed. Rep. of Germany ..... 2658885

[51] Int. Cl.[2] ..... C22B 5/28

[52] U.S. Cl. ..... 266/89; 266/245

[58] Field of Search ..... 74/409, 411.5, 410; 266/89, 245, 246, 247; 92/13.5

[56] References Cited

U.S. PATENT DOCUMENTS

| | | | |
|---|---|---|---|
| 2,404,865 | 7/1946 | Semar | 74/410 |
| 2,814,310 | 11/1957 | Lower | 92/13.5 |
| 3,173,337 | 3/1965 | Cunningham | 92/13.5 |
| 3,995,841 | 12/1976 | Riegler et al. | 266/246 |
| 4,070,923 | 1/1978 | Berthake | 74/411.5 |

*Primary Examiner*—Paul A. Bell

*Attorney, Agent, or Firm*—Mandeville and Schweitzer

[57] ABSTRACT

The invention refers to an apparatus for locking a converter tilting gear during a blasting operation, which apparatus is provided with a supplementary gear arrangement to facilitate counterrotation of pinions arranged in pairs versus the pivot pin gear wheel, so that the pinions may be locked and loosened by means of arresting brakes.

The arrangement is such that the gear trains for the individual drive pinions can pivot in relation to the position of the pivot pin gear wheel in synchronized fashion to accommodate play between the cooperating gear teeth.

10 Claims, 7 Drawing Figures

APPARATUS FOR LOCKING A CONVERTER TILTING GEAR DURING A BLASTING OPERATION

BACKGROUND AND DESCRIPTION OF THE INVENTION

During the refining period, vibrations occur which are caused by the reactions in the metal bath. The vibrations are transmitted to the brick lining and wall of the converter vessel. In case the converter vessel is supported by an annular support resting in a tilting stand by means of pivot pins, the vibrations travel via the supporting elements between converter wall and annular support, and via annular support to the pivot pins, and finally to the pivot pin gear wheel and gear wheel pinions, which transmit the drive power to the pivot pin gear wheel. The vibrations are particularly detrimental at the point of tooth engagement of the pivot pin gear wheel and the drive pinions. The apparatus of the invention serves to eliminate the destructive effects of the vibrations on the converter tilting gear.

It is a known fact from bottom-blast Thomas converters to form the converter tilting gear of two hydraulic plunger gears whose axes run parallel, perpendicular and tangential relative to the pivot pin gear wheel. Attached to the piston rods are racks which transmit the motive power to the pivot pin gear wheel. Such type of apparatus has already been utilized to lock the converter tilting gear. For locking in place, the racks are moved in countermovement so that the play between rack teeth and pivot pin gear wheel is compensated for. Modern converter tilting gears consist of gears slipped onto the converter pivot pin in "flying" or cantilevered fashion, and of a torque support attached to the gear box, such torque support catching the restoring moment or play of the entire gear arrangement in a stationary location. This type of gear is, therefore, locked in principle only by counterrotation of pinions arranged in pairs versus the pivot pin gear wheel. In the tilting position, the converter swiveling around the pivot pin axis is locked by means of air cooled arresting brakes.

Furthermore, it has been disclosed in German Pat. No. 2,554,912 to provide one of the pinions with an additional gear which is engaged only when the coordinated arresting brake has been disengaged, and the arresting brakes of the remaining pinions have retracted. This structure is based on the concept of reciprocally bracing only two tooth engagement pairs out of several. However, this still leaves the teeth of the remaining pinions, which are not completely engaged, subject to deterioration caused by vibrations.

The present invention is based on the task of achieving bracing of all pinions which are positioned against the pivot pin gear wheel, even to the extent of providing for existing faults in tooth division and similar deviations from theoretical data. This is done by coordinating each pinion, in addition to the arresting brake, with its own auxiliary swivel gear, and by synchronously driving all auxiliary swivel gears in conjunction with overlay gears, while arresting brakes are locked, and in conjunction with a power introduction in an intermediary shaft of a serial gear, while arresting brakes are briefly released, whereby the swivel gears are connected to either one common energy source or to a separate energy source, with each supplied by one common energy accumulator. This ensures adherence of all engaged pinion teeth to the counter-teeth of the pivot pin gear wheel. This eliminates vibration of the teeth on a large scale, which also eliminates knocking of individual teeth. Thus, the risk of vibrations causing damages in the gear is considerably reduced.

The invention may be realized with electrical, pneumatic as well as hydraulic means. Based on hydraulics, the invention takes the form of swivel gears consisting of hydraulically charged thrust engines (reversible hydraulic cylinders) connected, via pressure lines. to one common, or several individual, hydraulic pressure reservoirs, whose pressure is regulated. Identical torque can thus be made available to each pinion at the pinion shaft. In case there are faults in division, differences in tooth width, or similar manufacturing defects affecting contact of the teeth with each other, tension in the elastic area of bending stress may be increased, so that differential tension occurs at the teeth, and minor manufacturing defects are compensated for.

The degree of pressure in the pressure medium may be controlled in that the pressure reservoir or reservoirs connected to a pump may be continuously regulated for a constant pressure by means of pressure switches. This pressure control system is of particular advantage as pressure must be maintained only during the blasting period, i.e. for approximately 15 to 20 minutes. Based on the fact that the use of thrust engines in lieu of rotating motors represents a simplificaton of the auxiliary swivel gear in view of the current technical status, it is also favorable that each thrust engine consists of piston cylinder gears whose cylinder box is flexibly supported at the gear box of the pivot pin gear wheel, and whose piston rod may be disengaged and engaged at the shaft of a serial gear for each of the pinions.

The connection between the thrust engine and clutch can be done so that the piston rod of the thrust engine is indirectly connected to the serial gear via a lever hinged at the piston rod, such lever being attached non-rotatably with one part of the clutch. The clutch should be by-passed, however, if the invention further provides that the piston rod of the thrust engine is connected, via a hinged lever, to the serial gear shaft leading out of the gear box, such serial gear shaft pertaining to the sun wheel of a serial gear designed as planetary gear. Furthermore, the cylinder box is attached at the box of the serial gear, and the motor shaft of the planetary unit is connected to the pinion of the pivot pin gear wheel by means of several gear stages.

Another simplification permitting the pinion a relative movement versus the pivot pin gear wheel results from the fact that the thrust engine, consisting of a piston cylinder gear, is flexibly attached with its cylinder box and/or piston rod at the gear box of the pivot pin gear wheel on one side, and on the other side it is flexibly attached to the gear box of the serial gear for the pinion, and that the gear box for the pivot pin gear wheel and/or gear box for the pinion can be tilted at least the equivalent of the existing play. This tilting is achieved, in accordance with the invention by arranging the serial gear with gear box in swinging fashion around the shaft of the pinion in the gear box of the pivot pin gear wheel.

In order to control vibrations occurring during the refining process in the metal bath, which travel through the brick lining, vessel wall, supporting elements, annular support, pivot pin up to the gear, and which practically cannot be prevented, it is necessary to introduce a damping link. This link is provided to absorb the vibrations. In accordance with the present invention, such damping link is, preferably, arranged locally so that in at least one link of the power transmission between auxiliary swivel gear and pinion, one vibration absorber is placed. In this spot, it is very easy to maintain and/or exchange the vibration absorber.

If the invention is realized exclusively with hydraulic or pneumatic thrust engines, there may be different travel paths of pistons and/or cylinders. These differences are compensated for by coordinating each thrust engine with a stop, whose movement is limited by a counter-stop which is stationary and adjustable to different travel paths.

DETAILED DESCRIPTION OF THE INVENTION

Figure 1:
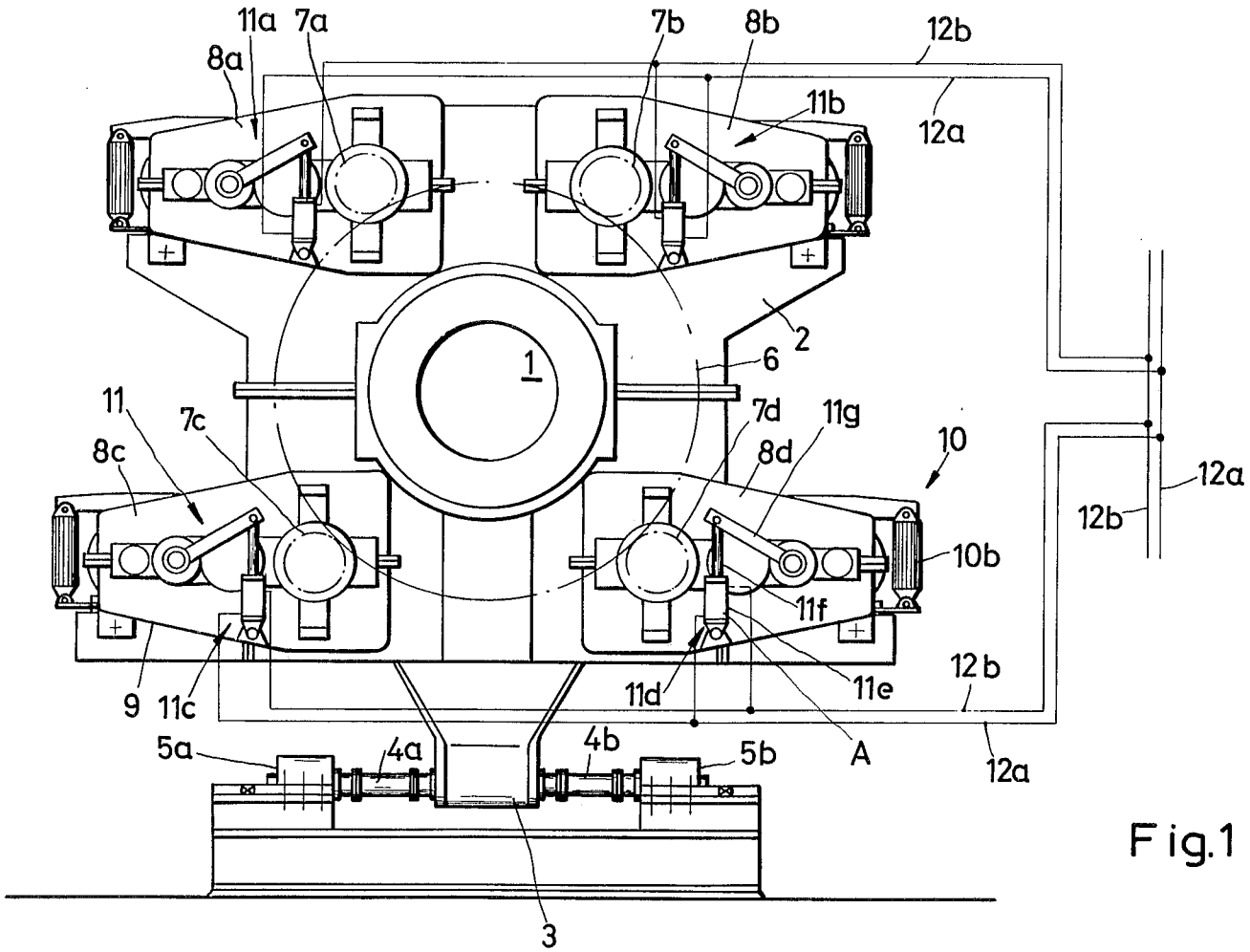
FIG. 1 is a somewhat diagrammatic end view of the pivot pin of a converter showing the tilting mechanism therefor in accordance with the invention.

The apparatus of the invention is intended for a converter tilting gear, which is arranged on pivot pin 1 of gear box 2 in removable fashion, and which is supported via torque support 3 attached to gear box 2, via ball joints *4a* and *4b* against the stationary abutments 5*a* and 5*b* in both directions of rotation. The converter tilting gear consists essentially of large pivot pin gear wheel 6, which is driven by means of several smaller gear wheels, so-called pinions 7 (*7a, 7b, 7c, 7d*) by engine power. Each pinion 7 is part of a serial gear 8 (8*a*, 8*b*, 8*c*, 8*d*) each supported at gear box 2 with their individual gear box 9 (*9a, 9b, 9c, 9d*). Pinions 7 are arranged in pairs in order to avoid an odd number. An odd number of pinions would result in uneven power distribution at the circumference of the large pivot pin gear wheel 6, and would increase wear on the gear teeth.

Each of the serial gears 8 has several parallel shafts for several gear stages. According to FIG. 1, four stages are provided, and the fourth shaft carries the brake discs for arresting brakes 10 and motor 10*a*, of which essentially brake cylinder 10*b* is visible on FIG. 1. Serial gear 8 will be described in detail in FIG. 6. Each serial gear is equipped with an auxiliary swivel gear 11 (11*a*, 11*b*, 11*c*, 11*d*). This consists in the example shown of one hydraulically charged thrust engine with cylinder box 11*a*, one piston rod 11*f*, one hinged lever 11*g*, connected to one of the four gear shafts.

Figure 2:
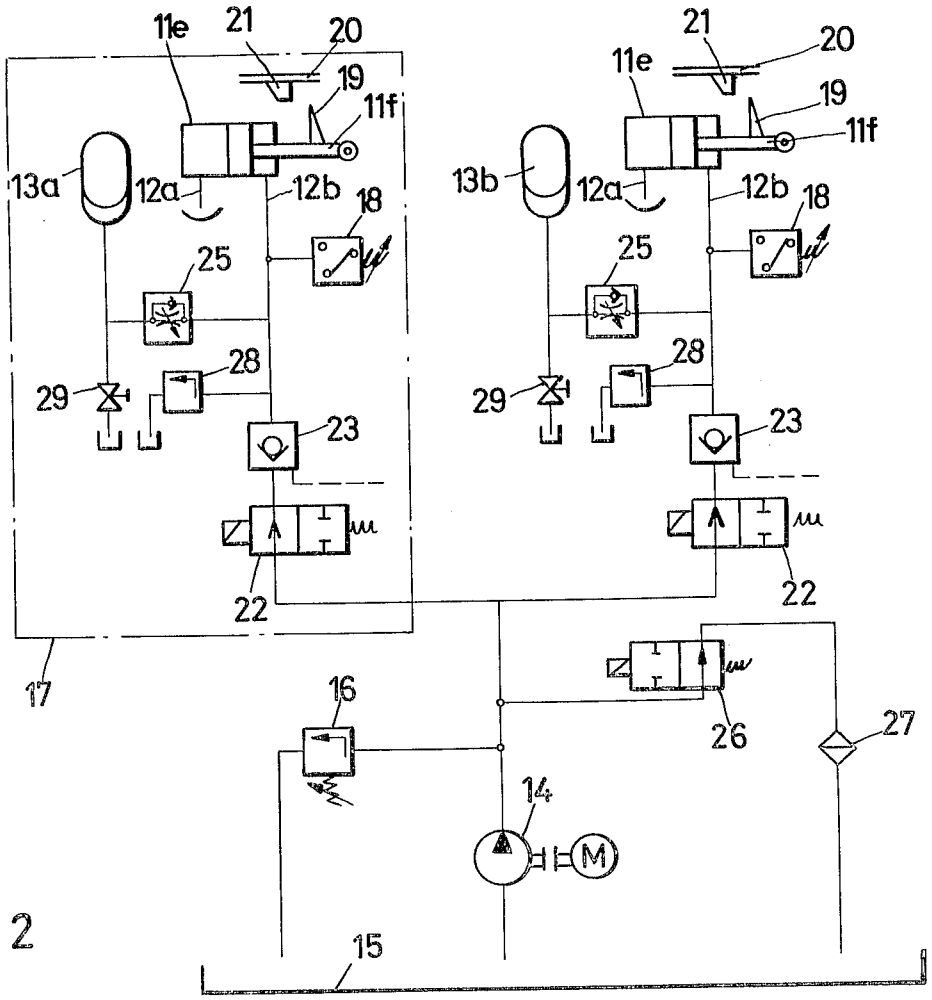
FIG. 2 is a flow diagram showing one embodiment of control apparatus for the tilting mechanism of the invention.

In FIG. 1 auxiliary swivel gear 11 is shown in zero position. Each of the auxiliary swivel gears is connected to the hydraulic system shown on FIG. 2 by means of supply pressure line 12*a* and/or return pressure line 12*b*. The hydraulic system according to FIG. 2 provides hydraulic pressure reservoirs 13*a* and 13*b*. The pressure medium is delivered by means of pump 14 from reservoir 15 with a setting for pressure which can only mount up to a permissible level controlled by pressure relief valve 16.

Each cylinder box 11*e* is assigned to control and work area 17. Two such areas 17 are, as a rule, to be provided for two counter-rotating pinions 7 (*7a,/7b; 7c/7d*). The example given in FIG. 3 shows how two pinions of half the pressure are rigged in cylinder boxes 11*e* matching their pressure surface versus a third pinion of full pressure in cylinder box 11*e*, so that, again, rigging "in pairs" is provided for.

The working pressure required in cylinder boxes 11*e* for the pressure medium may be adjusted within certain limits by means of a pressure switch 18 for pump 14. Piston rod 11*f* is provided with stop 19 which operates in conjunction with counter-stop 21 arranged on rail 20 adjustable on gear box 9. The counter-stop 21 limits the stroke of the piston with piston rod 11*f*, so that the travel path of the piston is somewhat greater than the greatest play which may occur between the several pinions 7 and the toothing of pivot pin gear wheel 6. This has the advantage of taking into consideration an operation of several cylinder boxes 11*e* which is possibly not 100% synchronous. Simultaneously, it makes it possible to use the principle of the invention for a greater number of pinions in order to obtain a large number of clamping points around the circumference of the large pivot pin gear wheel.

The operation of the hydraulic system is as follows: Pump 14 increases pressure, with two way valves 22 and remote-controlled check valve 23 being opened, until pressure set in pressure switch 18 is reached, upon which check valve 23 and two way valve 22 will close. This pressure is now present also in pressure reservoir 13*a*, which is connected to pump pressure line 12*b* via throttle valve 25. As soon as the maximum pressure set in the pressure switch 18 is reached, pressure switch 18 turns off check valve 23 and two way valve 22. Pump 14 is turned off as well. A quantity of pressure medium delivered subsequently by pump 14 returns to the reservoir 15 via two way valve 26 and filter 27. The pressure as set allows stop 19 to reach counter-stop 21, so that all pinions are braced, whereby the stop setting prevents at the same time the converter moving by any small, yet undesirable, degree from the set tilting position, before the first pinion reaches its counter-flank at the pivot pin gear wheel. Such movement of the piston could, with a certain type of serial gears, also take place when arresting brake 10 has retracted. Should it occur that pressure drops in cylinder box 11*e*, e.g. due to leak oil loss of thrust engine 11, a pressure balance takes place via pressure reservoir 13. In case of a greater drop in pressure, however, pressure switch 18 engages pump 14 and check valve 23 as well as two way valve 22 are set for flow-through. Then pump 14 increases the pressure to the value set in pressure switch 18. Pressure reservoir 13 (13*a*, 13*b*) is provided with pressure restriction valve 28 as well as discharge valve 29.

Figure 3:
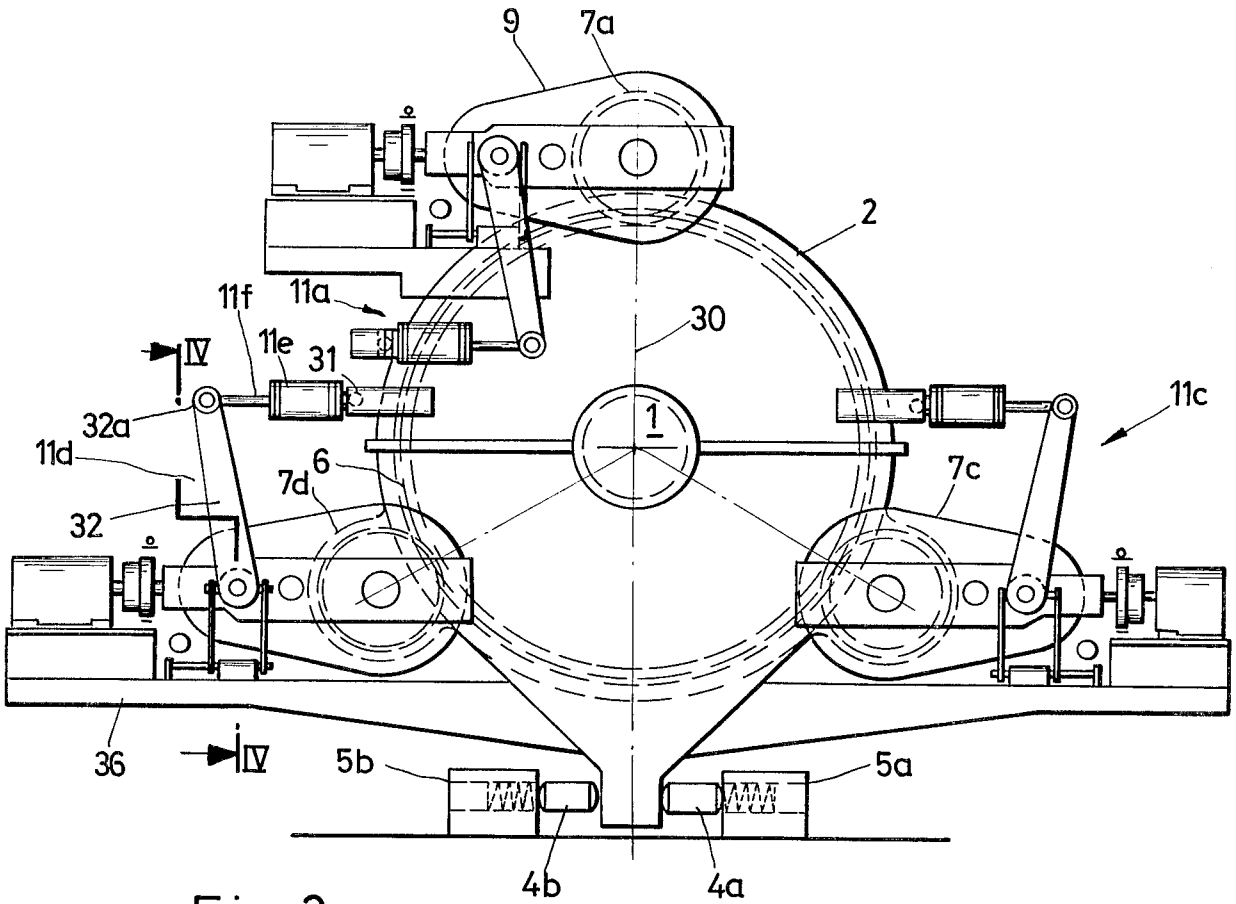
FIG. 3 is a modification of the arrangement of FIG. 1, with a reduced number of drive pinions for the tilting arrangement of the invention.
Figure 4:
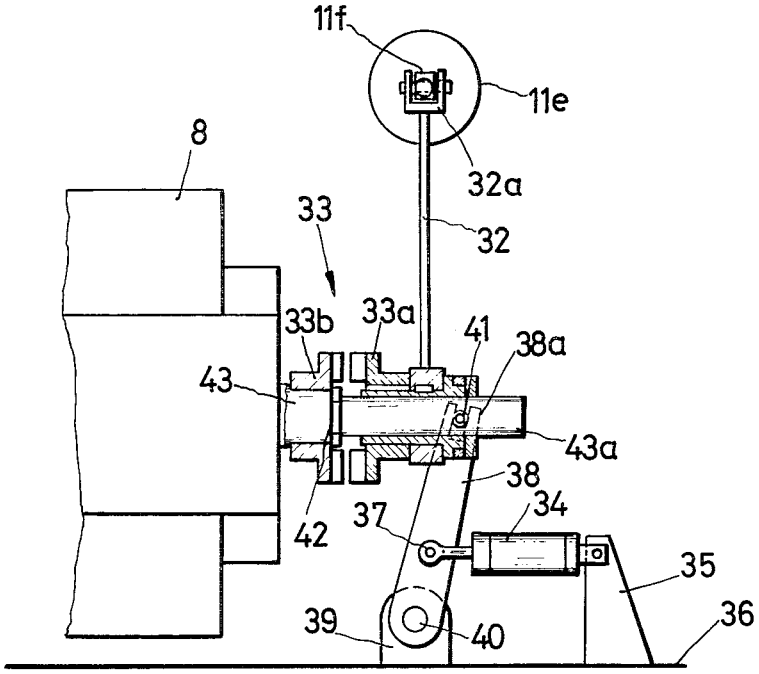
FIG. 4 is a cross sectional view taken along lines IV—IV of FIG. 3.

The example of FIG. 3 shows pivot pin 1 with pivot pin gear wheel 6 coordinated with two pinions 7*c* and 7*d* symmetrical with perpendicular axis 30. The third pinion 7*a* is located on axis 30 itself. Pinion 7*a* is, as described, hydraulically assigned pinion 7*c* or pinion 7*d* and driven in the proper direction in order to obtain bracking "in pairs". The respective boxes 11*e* are attached to gear box 2 by means of joint 31. Lever 32 is hinged at piston rod 11*f* by means of a fork 32*a* (FIG. 4). Joint 31 enables the entire cylinder box 11*e* to swivel to the left or to the right (in FIG. 4). Lever 32 embraces displaceable clutch part 33*a* of clutch 33 non-rotatably and can be actuated by means of thrust engine 34, hinged at bracket 35 on support 36 and connected to joint 37 at rocking lever 38.

For this purpose, rocking lever 38 pivots on abutment 39 on support 36 on pivot pin 40 and guided on projection 41 by means of fork 38*a*. Clutch part 33*b* rotates with its respective serial gear and forms rotary bearing 42 for shaft part 43*a* of serial gear 43, and stands still when declutched.

Figure 5:
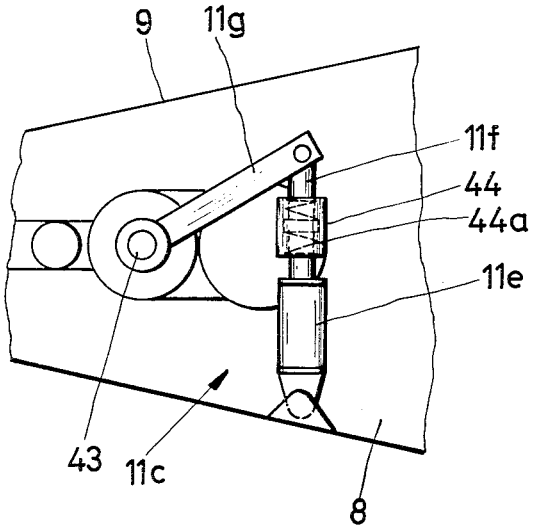
FIG. 5 is a view of the general area marked A in FIG. 1, and enlarged to show the details thereof.

According to the example in FIG. 5 piston rod 11*f* is interrupted, and vibration absorber 44 connects the two parts slipping together in telescope fashion. Vibration absorber 44 is provided with compression spring 44*a* and, as usual, filled with pressure oil.

Figure 6:
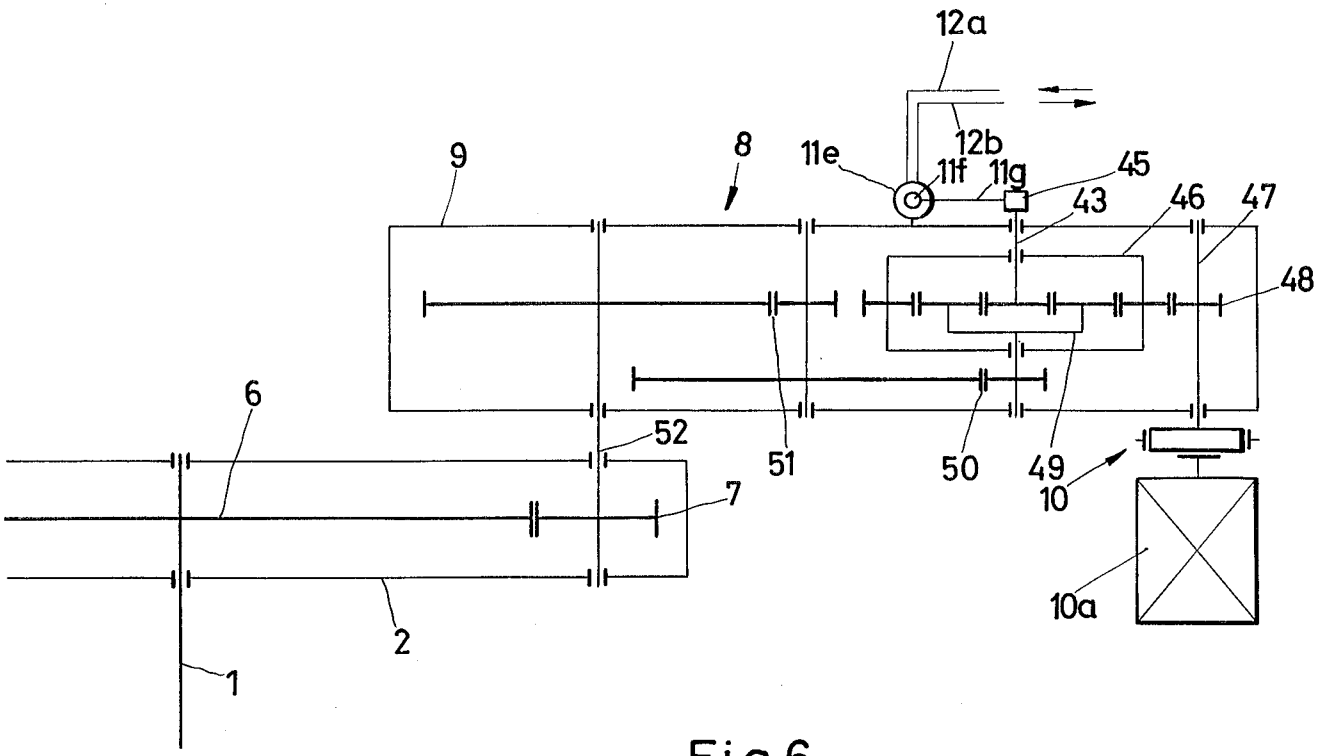
FIG. 6 is a somewhat diagrammatic view in horizontal axial cross section of a further embodiment of the invention, and showing a representative connection between one drive pinion and the pivot pin gear wheel.
Figure 7:
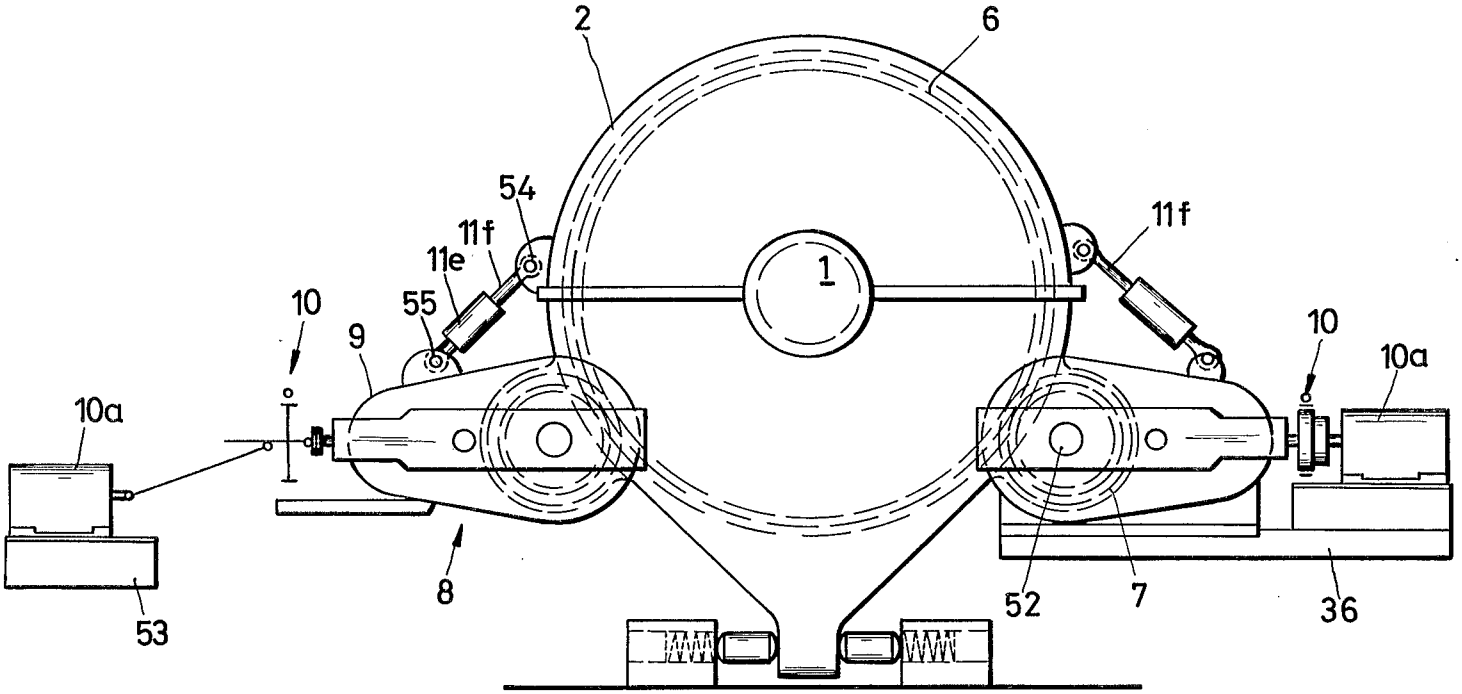
FIG. 7 is a view similar to FIG. 1 showing a further embodiment of the invention, and showing further the drive motor for one pinion on the left positioned at a greater distance than the one on the right, and connected by a universal joint.

In another example shown in FIG. 6, the auxiliary swivel gear is hinged at gear box 9 with cylinder box 11*e*. Piston rod 11*f* is connected to extended serial gear shaft 43 by means of pin joint 45 and lever 11*g*. Sun wheel 46 is arranged on serial gear shaft 43 in rotary fashion, thus forming a first gear stage with motor shaft 47 and motor pinion 48. At the exterior of serial gear 8, arresting brake 10 and motor 10*a* are arranged on the support 36 (FIG. 7). Support 36 is usually attached to serial gear 8, as at gear box 9. Planetary gear 49, and gear wheel pairs 50 and 51 form another gear stage for a preferably large transmission area. Auxiliary swivel gear 11 represents here an override gear which may be engaged as second gear within the planetary gear without providing clutch 33. Shaft 52 for pinion 7 carries part of the weight of serial gear 8 which is also supported via motor shaft 47 on support 36.

A further example shown in FIG. 7 also eliminates a clutch which may be engaged and disengaged, whereby motor 10*a* rests either on a separate foundation 53 or on support 36. Arresting brake 10 is arranged on respective supports 36. Box 9 of serial gear 8 is connected to gear box 2 of pivot pin gear wheel 6 via auxiliary swivel gear 11. To this end, for example, piston rod 11*f* forms a joint 54 with gear box 2, and cylinder box 11*e* also forms a joint 55 with gear box 9 of serial gear 8. Gear box 8 is arranged in swinging fashion around shaft 52 of pinion 7 in the manner of serial gear 8 according to FIG. 6.

We claim:

1. Apparatus for locking the tilting gear of a converter during a blasting operation, comprising
   (a) a pivot pin gear wheel;
   (b) a plurality of drive pinions engaging said pivot pin gear wheel and spaced circumferentially therearound;
   (c) a source of power; the improvement characterized by
   (d) a separate first drive means for each pinion;
   (e) gear train means connecting each said drive means to its respective drive pinion;
   (f) arresting brakes in each said gear train means;
   (g) a separate second drive means connected to each said gear train means for providing relative angular motion of each said pinion which said pivot pin gear wheel for engaging individually the teeth of each pinion with said pivot pin gear wheel;
   (h) means providing simultaneous flow communication from said power source to each said second drive means; and
   (i) control means in said flow communication means for synchronously driving all said second drive means when said arresting brakes are briefly released.

2. The apparatus of claim 1, further characterized by
   (a) a vibration absorber in each said second drive means.

3. The apparatus of claim 1, further characterized by
   (a) each said second drive means means is a reversible pressure fluid piston and cylinder unit;
   (b) a pressure fluid reservoir in said flow communication means for each said piston and cylinder unit; and
   (c) a pressure switch for each said piston and cylinder unit for said synchronized operation.

4. The apparatus of claim 3, further characterized by
   (a) said power source is a hydraulic power source; and
   (b) each said piston and cylinder unit is a hydraulic unit.

5. The apparatus of claim 3, further characterized by
   (a) a gear box for said pivot pin gear wheel;
   (b) each said pressure fluid cylinder is connected to said gear box; and
   (c) the piston rod of each said piston and cylinder unit is releasably connected to said gear train means.

6. The apparatus of claim 5, further characterized by the releasable connection of each said piston rod comprising
   (a) a clutch mounted on a shaft of one gear in said gear train means;
   (b) a connecting rod with one end fixed on one part of said clutch; and
   (c) the opposite end of said connecting rod hinged to the end of said piston rod.

7. The apparatus of claim 5, further characterized by
   (a) each said gear train means is a planetary gear arrangement;
   (b) a hinged lever connecting each said piston rod to the sun gear of each said planetary gear;
   (c) the cylinder of each said piston and cylinder arrangement is fixed on the gear box of each said gear train means; and
   (d) a plurality of intermediary gears connecting each said planetary gear arrangement to its respective drive pinion.

8. The apparatus of claim 3, further characterized by
   (a) a gear box for said pivot pin gear wheel;
   (b) a gear box for each said drive pinion and gear train means; and
   (c) one end of each said piston and cylinder unit pivotally connected to said pivot pin gear wheel box, and the other end is pivotally connected to its respective box for said drive pinion and gear train means.

9. The apparatus of claim 8, further characterized by
   (a) each said gear box for each said drive pinion and gear train means is pivotal around the shaft of its respective drive pinion.

10. The apparatus of claim 3, further characterized by
   (a) a stop on each said piston and cylinder unit;
   (b) a fixed counter-stop for engaging each stop; and
   (c) means on said counter-stop for adjusting the positioning thereof for adjusting the length of movement of said piston and cylinder unit.

* * * * *